US010557260B2

(12) United States Patent
Nitti

(10) Patent No.: US 10,557,260 B2
(45) Date of Patent: Feb. 11, 2020

(54) AUTOMATED SYSTEM FOR DRAINING, CLEANING AND SANITIZING OF PORTABLE TOILET SEWAGE HOLDING TANK USED IN RECREATIONAL VEHICLES SUCH AS CAMPERS, CARAVANS, BOATS ETC

(71) Applicant: Sergio Nitti, Zagarolo (IT)

(72) Inventor: Sergio Nitti, Zagarolo (IT)

( * ) Notice: Subject to any disclaimer, the term of this patent is extended or adjusted under 35 U.S.C. 154(b) by 236 days.

(21) Appl. No.: 15/523,941

(22) PCT Filed: Nov. 6, 2015

(86) PCT No.: PCT/IT2015/000270

§ 371 (c)(1),
(2) Date: May 3, 2017

(87) PCT Pub. No.: WO2016/071940

PCT Pub. Date: May 12, 2016

(65) Prior Publication Data

US 2017/0335558 A1 Nov. 23, 2017

(30) Foreign Application Priority Data

Nov. 6, 2014 (IT) ..... RM2014A0648

(51) Int. Cl.
*E03F 1/00* (2006.01)
*E03F 5/10* (2006.01)
*E03F 7/00* (2006.01)

(52) U.S. Cl.
CPC ..... *E03F 1/008* (2013.01); *E03F 5/108* (2013.01); *E03F 7/00* (2013.01)

(58) Field of Classification Search
CPC ..... E03F 1/008; E03F 5/108; E03F 7/00
See application file for complete search history.

(56) References Cited

FOREIGN PATENT DOCUMENTS

| | | | | |
|---|---|---|---|---|
| DE | 20308586 U1 * | 11/2003 | ..... | B60R 15/04 |
| EP | 2230133 A1 * | 9/2010 | ..... | B60R 15/04 |
| EP | 2770129 A2 * | 8/2014 | ..... | E03F 1/008 |
| WO | WO-2012146767 A1 * | 11/2012 | ..... | B60R 15/04 |

* cited by examiner

*Primary Examiner* — Ryan A Reis
(74) *Attorney, Agent, or Firm* — DLA Piper LLP (US)

(57) ABSTRACT

Machine for emptying, washing and sanitizing of the portable tanks used in the toilets of recreational vehicles (for example, campers, motor homes, caravans and boats), characterized by a structure widi sliding door, in which the tank is inserted; the machine comprises sensors capable of detecting the type of the tank inserted. The washing procedure starts by rotating the pour-out spout, unscrewing the lid and lifting the tank into a vertical position, thus emptying it into the drainage system. A coupling mask then automatically slides open the lid and opens all the valves and sealing plugs. A lance then injects water and detergent at high pressure inside the tank, thus washing inside. The machine then washes the outside of the tank and of the cap of the same, filling it widi sanitizing liquids, drying and re-delivering it to the user through its completely automated, electronically-controlled method thus guaranteeing hygiene and safety. The machine provides for direct connection to the sewerage system or to a collecting tank and backup systems for electricity and water supplies.

15 Claims, 11 Drawing Sheets

Fig. 1.1
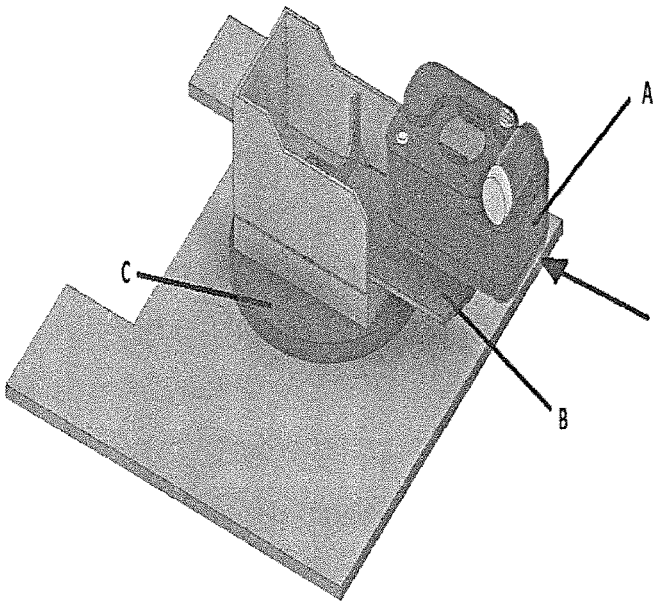
Fig 1.2
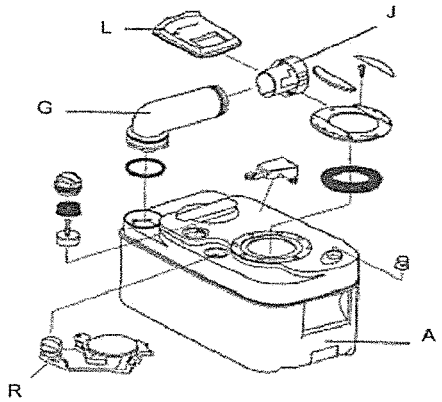
Fig 1.3
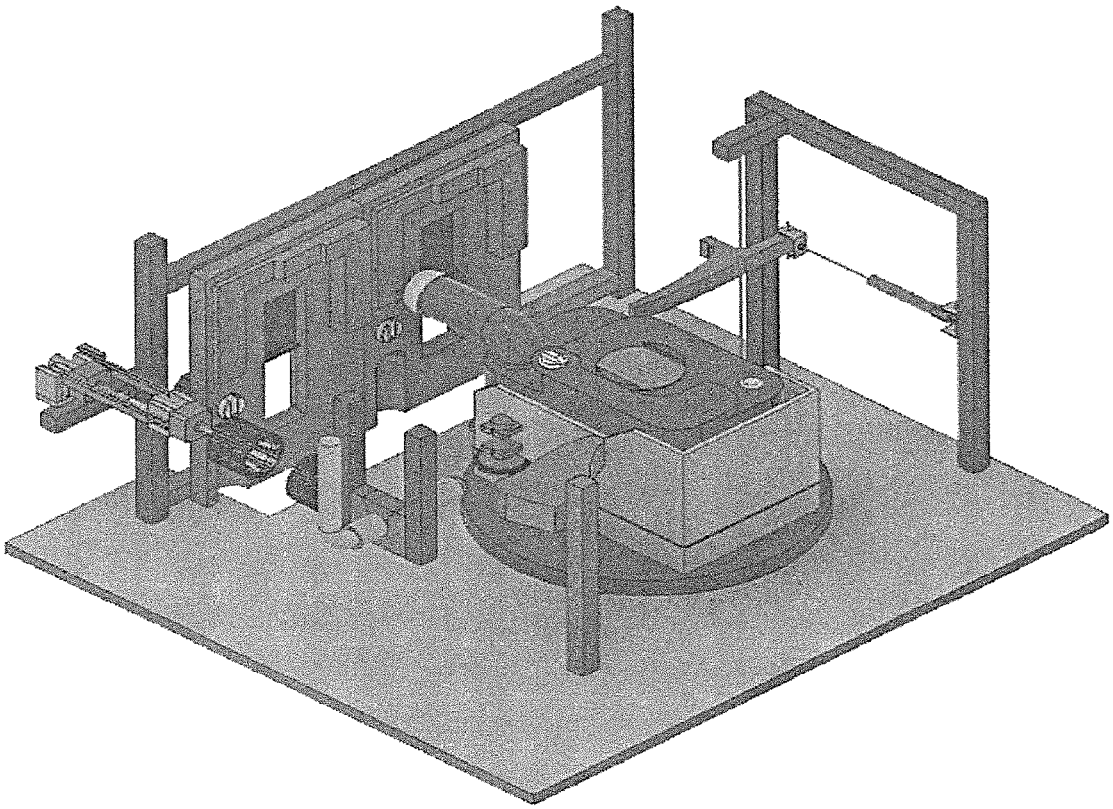

Fig. 2.1
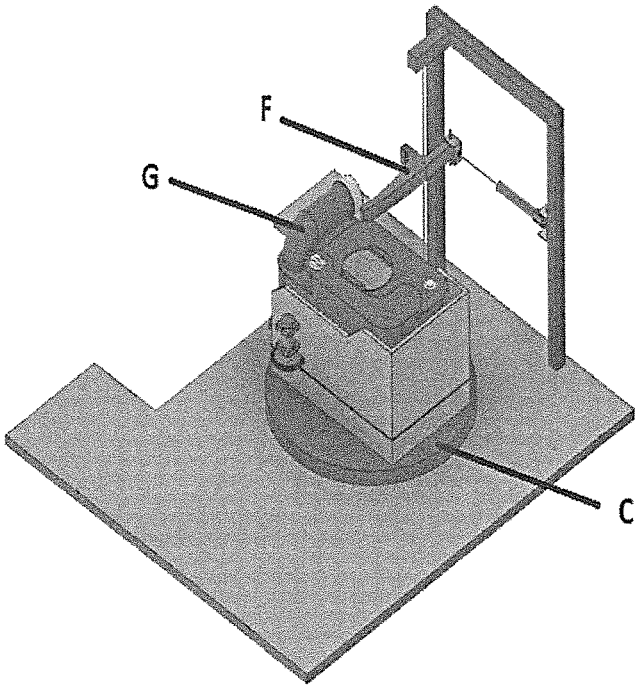
Fig. 2.2
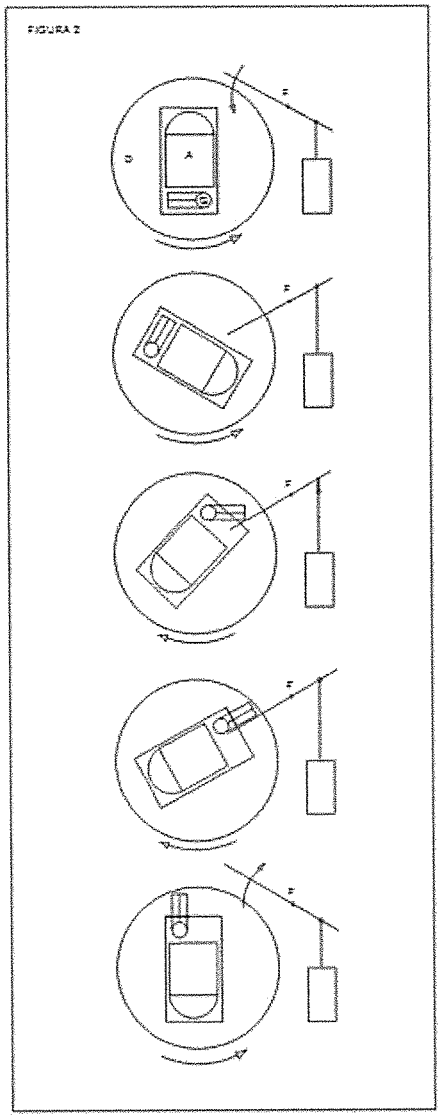
Fig. 2.3
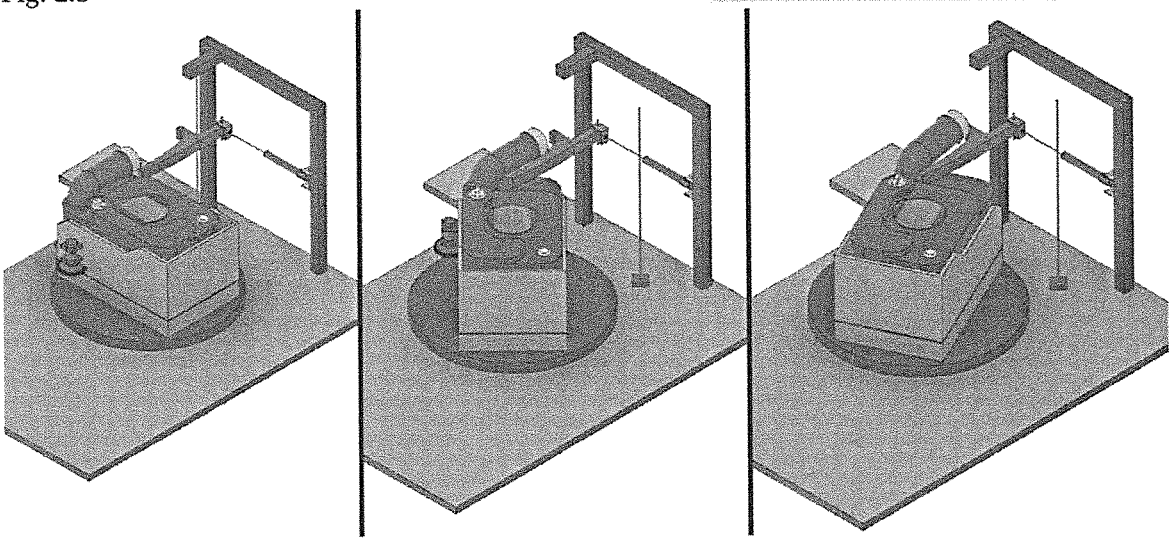

Fig. 3.1
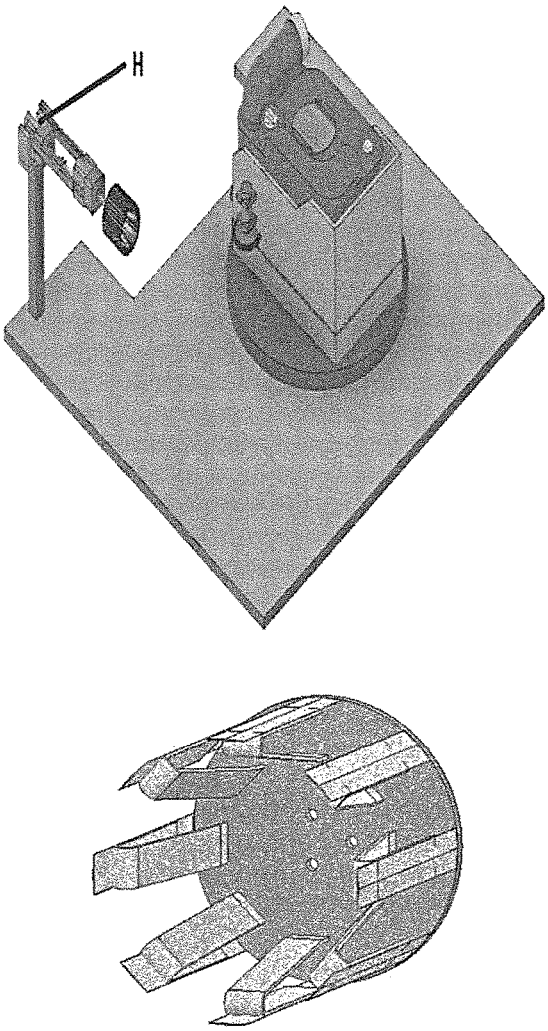
Fig. 3.2
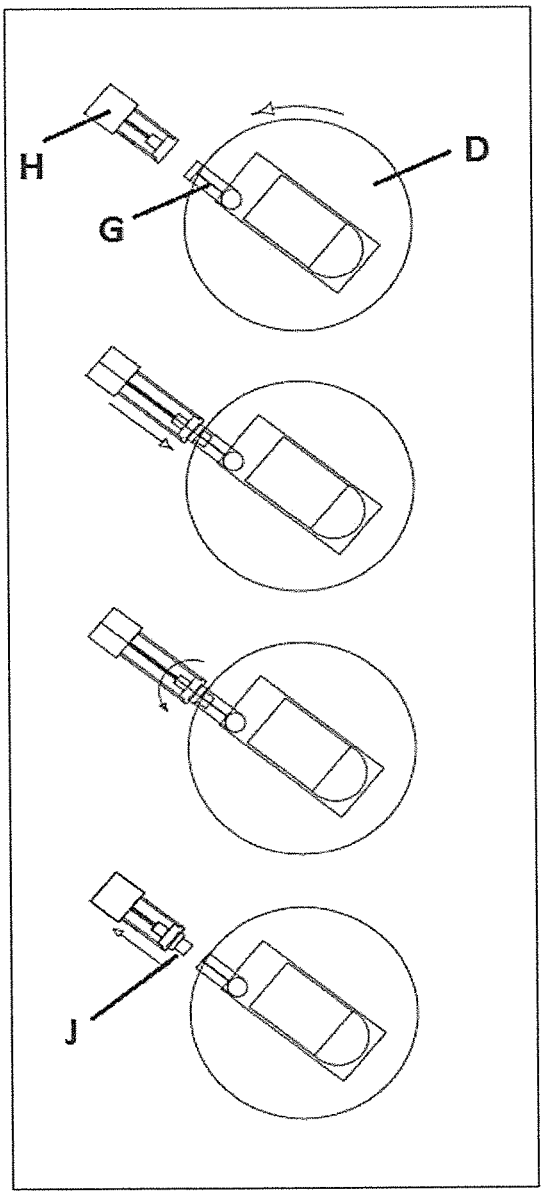
Fig. 3.3
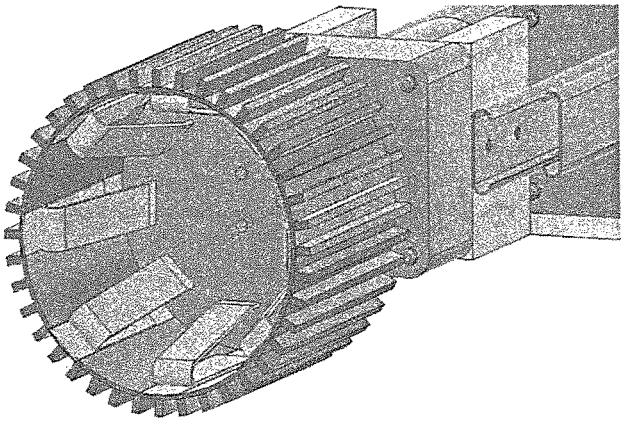
Fig. 3.4

Fig. 4.1
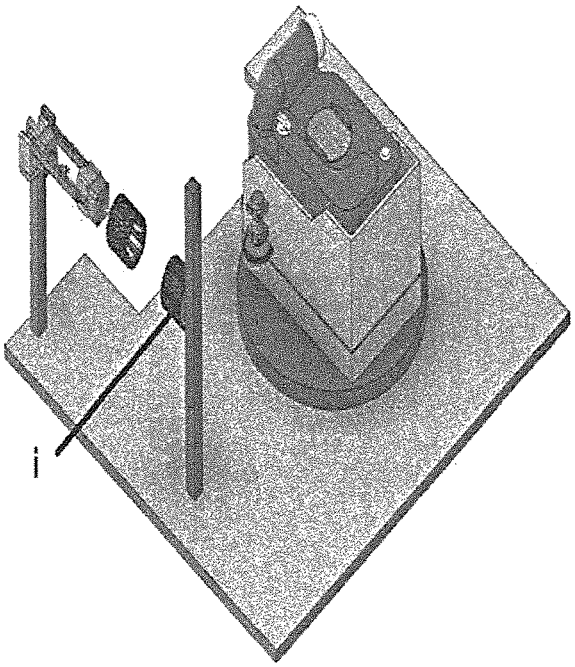
Fig. 4.2
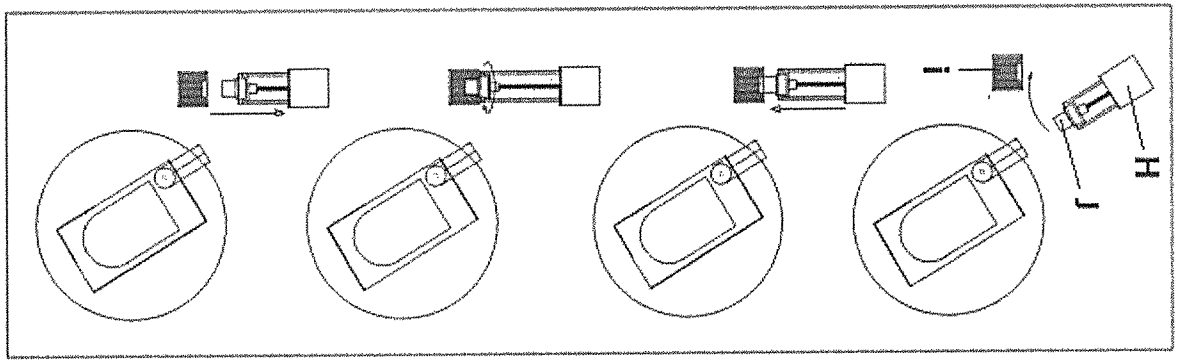
Fig- 4.3
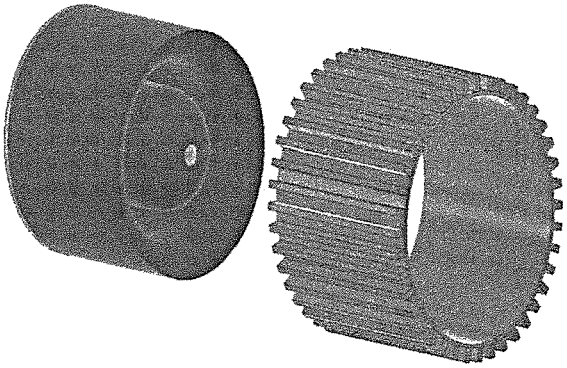
Fig. 4.4
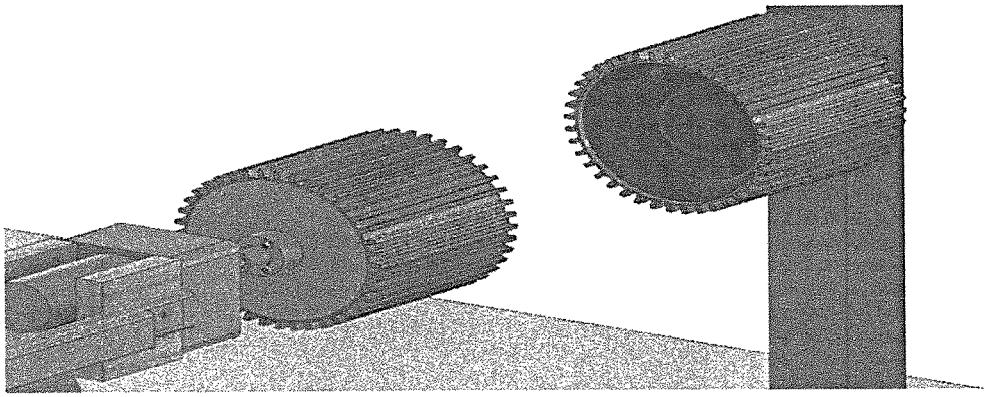

Fig. 5.1
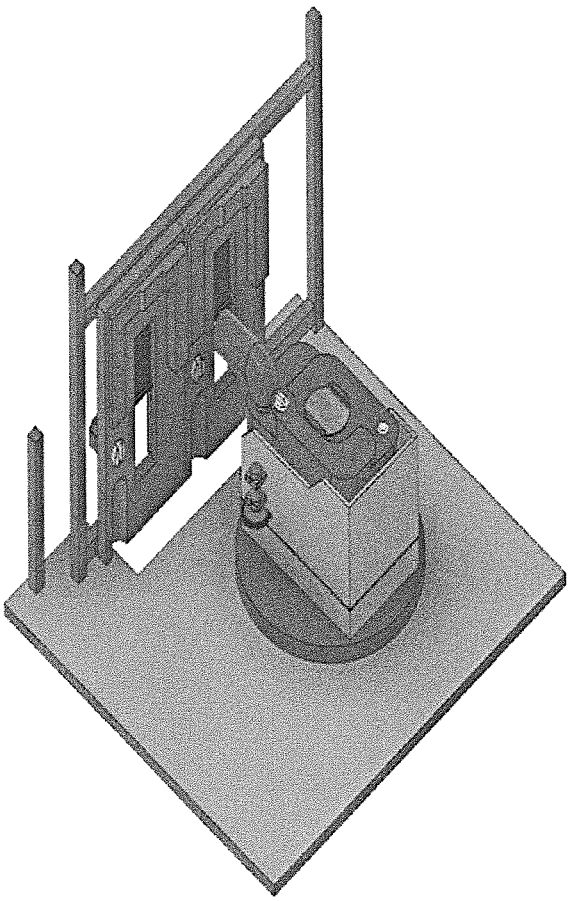
Fig. 5.2
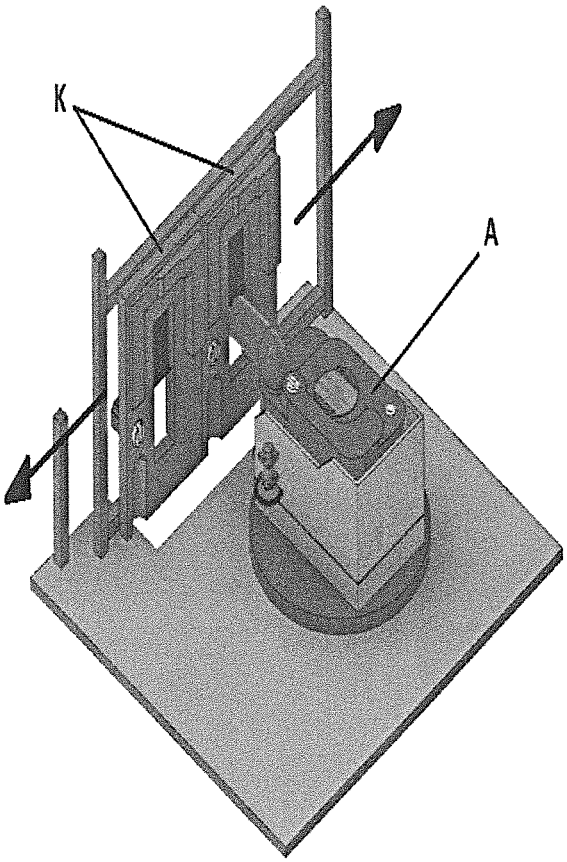
Fig. 5.3
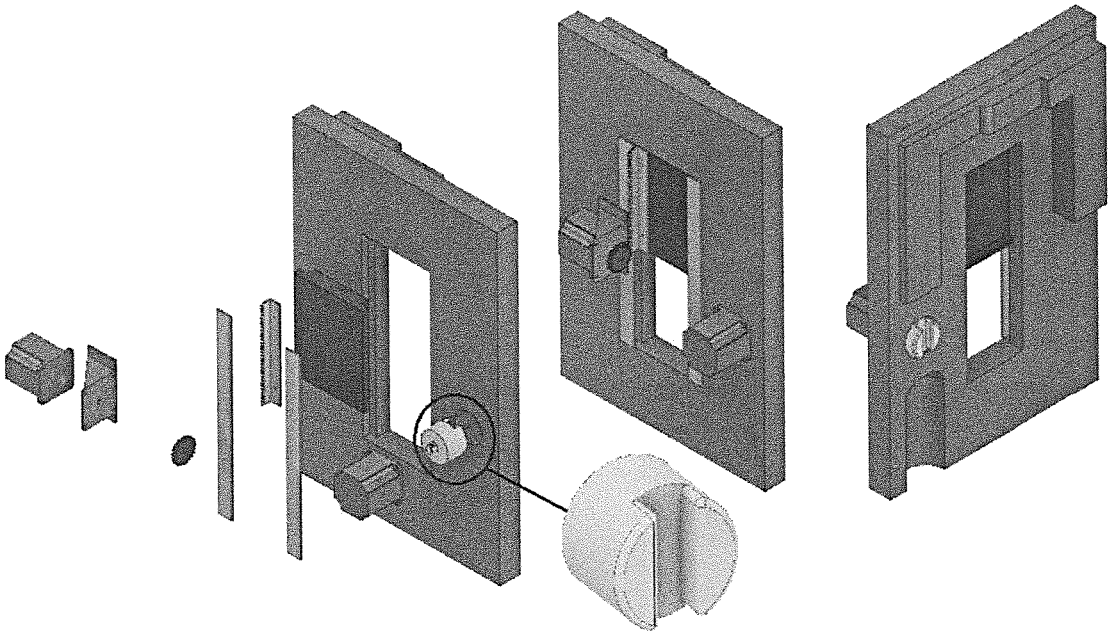

Fig. 6.1
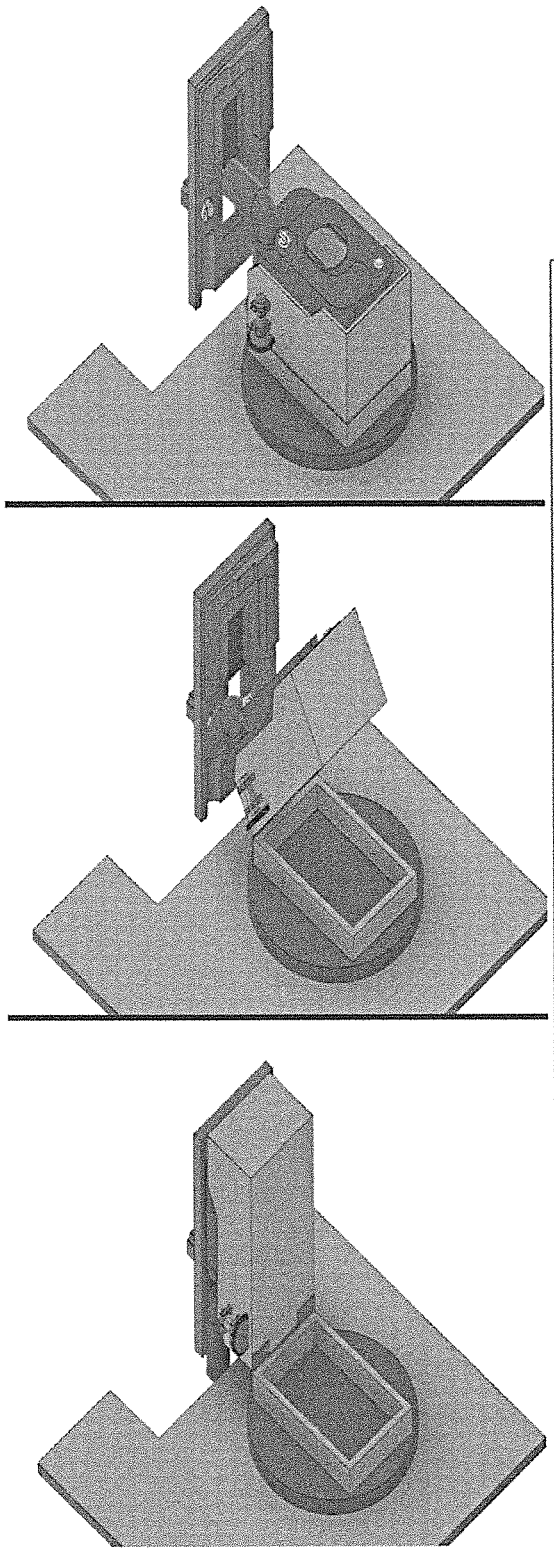
Fig. 6.2
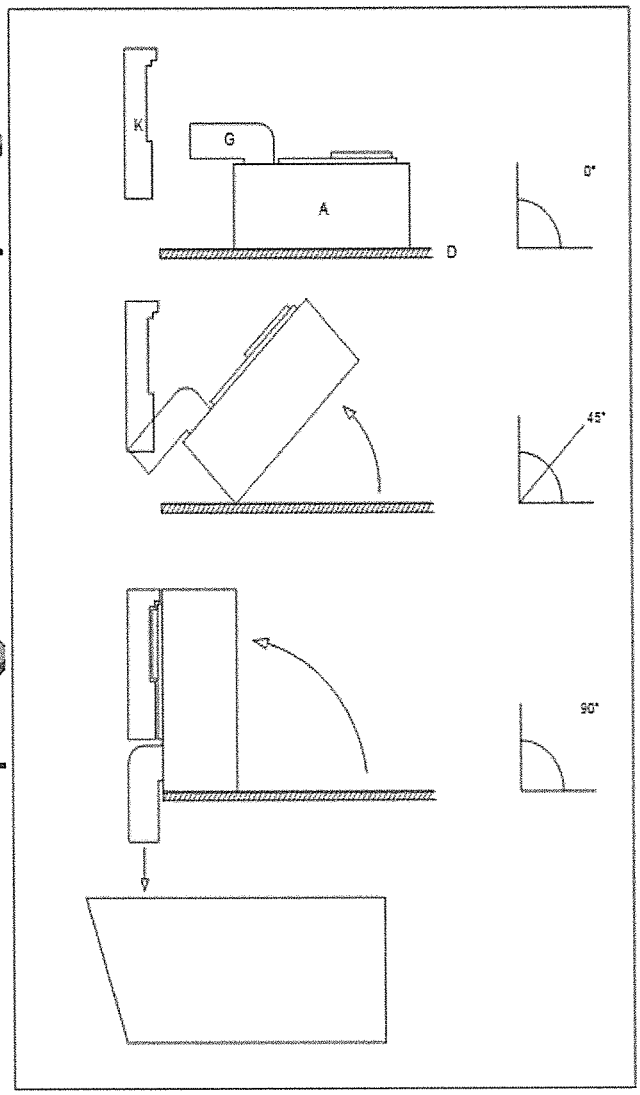

Fig. 7.1
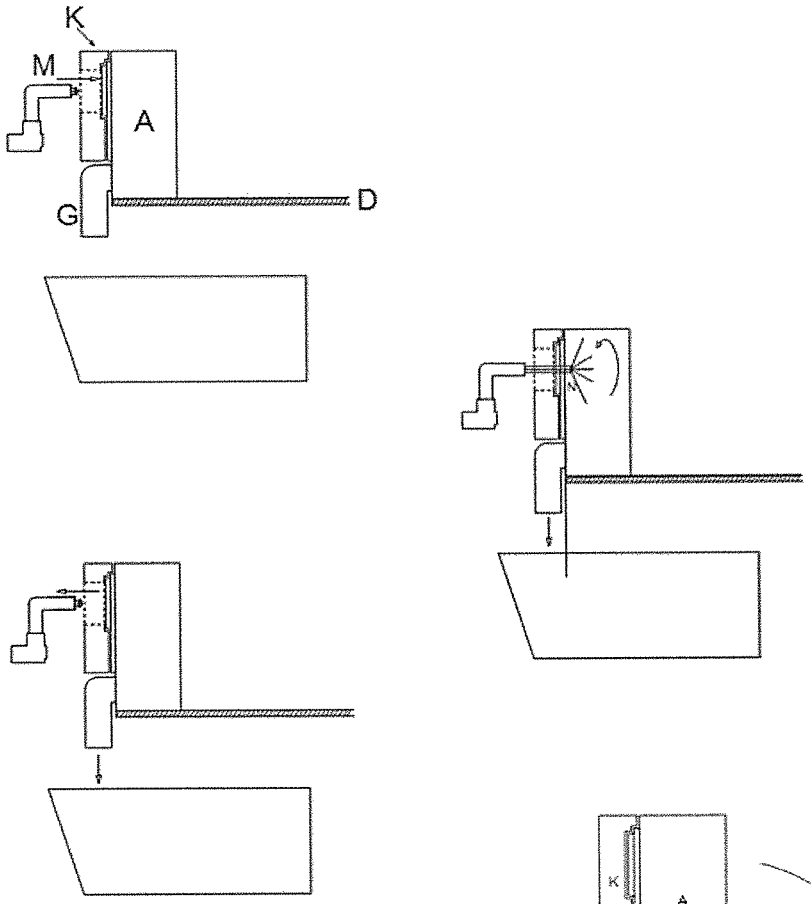
Fig. 7.2
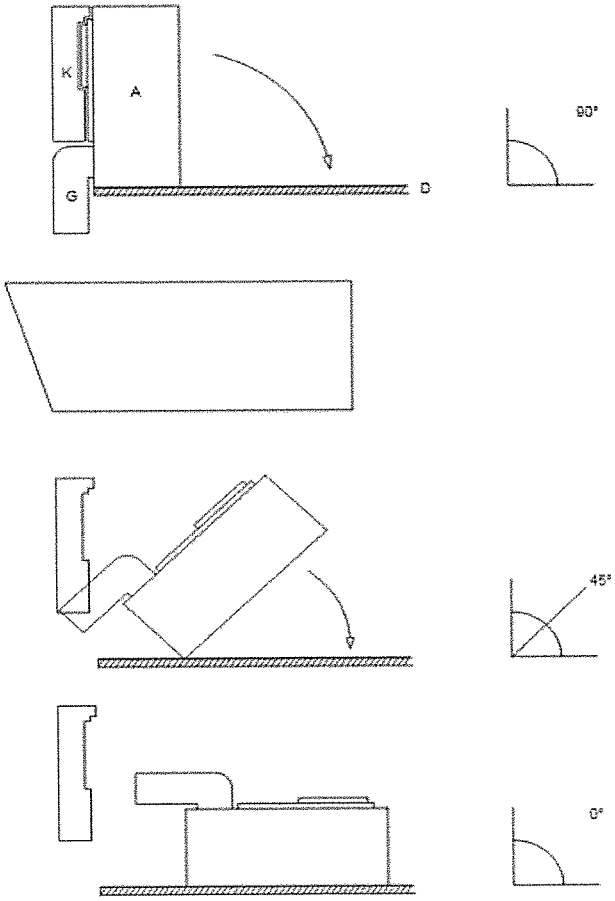

Fig. 8.1
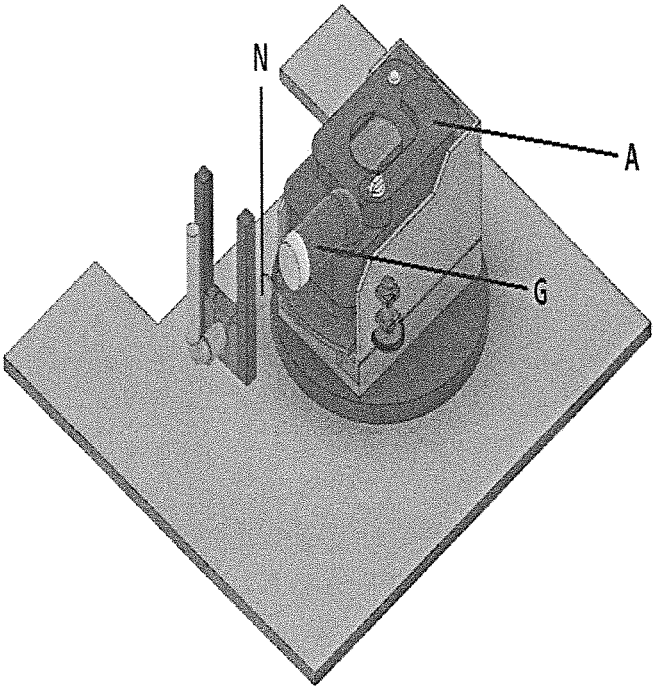
Fig. 8.2
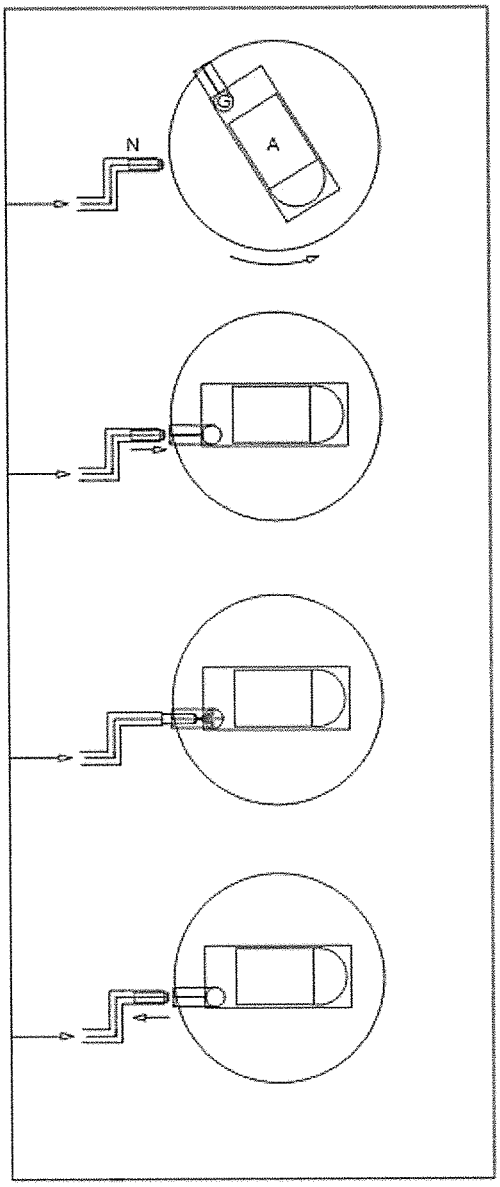

Fig. 9.1
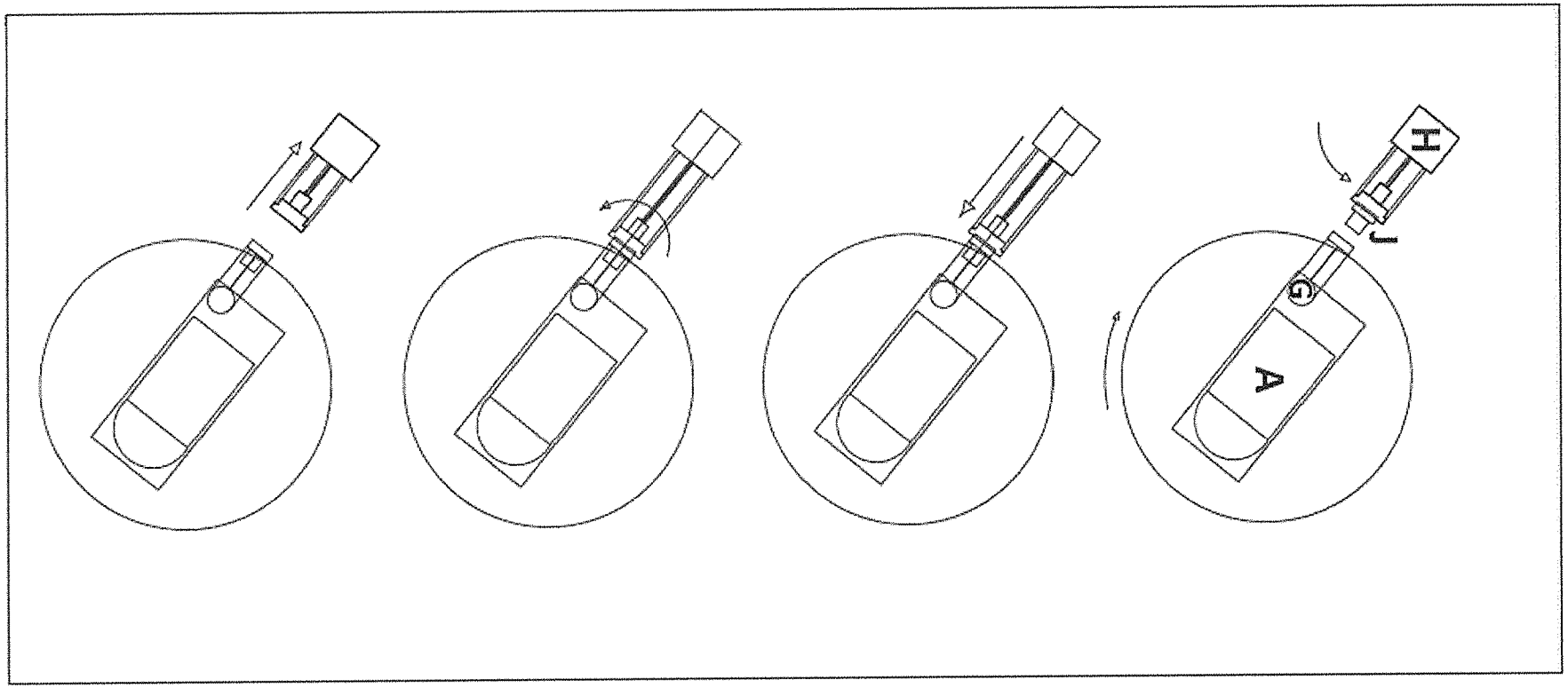

Fig. 10.1
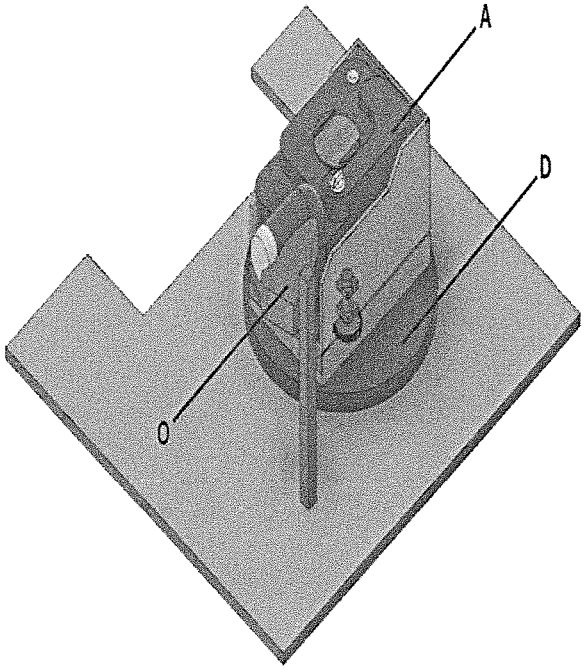
Fig. 10.2
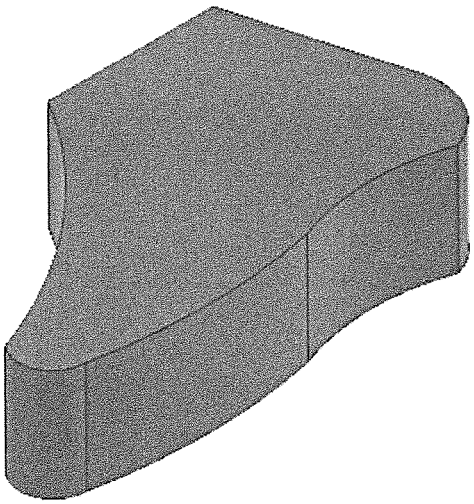
Fig. 10.3
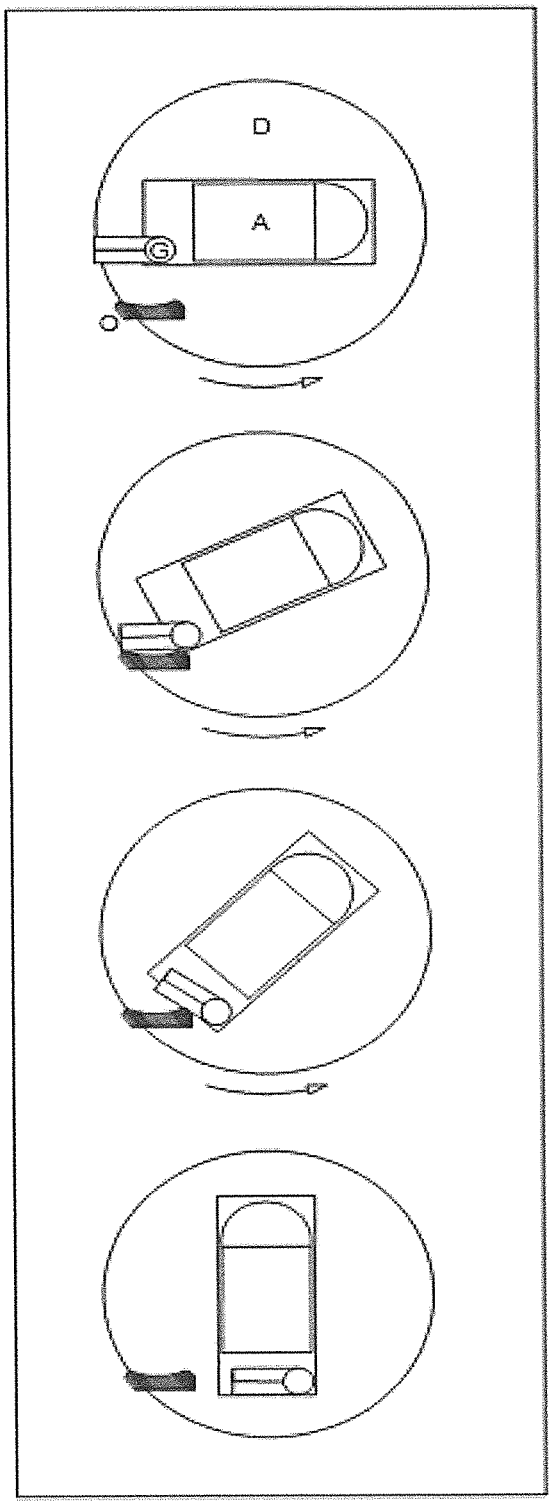

Fig. 11.1
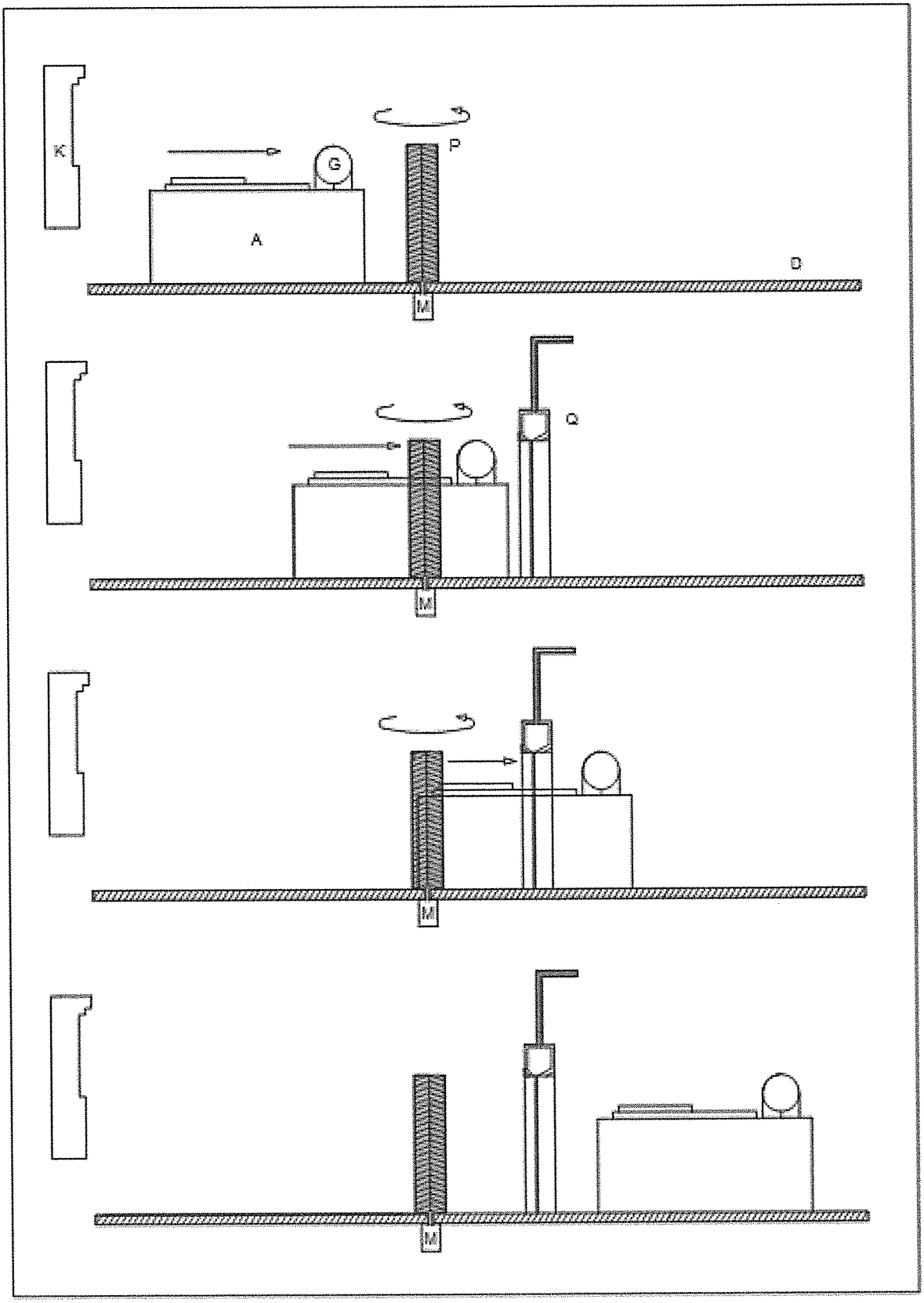

AUTOMATED SYSTEM FOR DRAINING, CLEANING AND SANITIZING OF PORTABLE TOILET SEWAGE HOLDING TANK USED IN RECREATIONAL VEHICLES SUCH AS CAMPERS, CARAVANS, BOATS ETC

TECHNICAL FIELD

Means of transport such as recreational campers, boats, motor homes, etc., come equipped with on-board bathrooms with removable sewage tanks for the disposal of sewage from the use of the toilets.

This presupposes the need for a regular and frequent emptying of the same, in itself an unpleasant operation, given the need to comply with applicable environmental protection regulations that prohibit the disposal of sewage anywhere but in properly equipped sites.

BACKGROUND ART

To the current state of the Art, (ref. patents. MI2013U000104; DE 203 08 586 U1) this emptying operation is performed manually or semi-automatically with the following difficulties and problems:

a) there are a variety of manufacturers and models of sewage tanks on the market, such as "Thetford" and "Dometic" (by way of example only) and the differences are not taken into consideration by the current state of the Art;

b) human intervention for the opening of the cap, the washing of the cap, the opening and closure of the slide and vent knob, and final closing of the cap is still required, resulting in an unpleasant and unhygienic experience for the person who performs this operations as well as raising health risk due to the promiscuity of the sites and the probable proliferation of bacteria;

c) Risk of contamination and pollution (both bacterial and olfactory) caused by lack of a rinsing system within the machine itself, following its use by the previous user.

DISCLOSURE OF INVENTION

The aim of the system, referred to in the present invention, is to create a machine capable of recognizing the type of tank inserted and exclude manual operations of any nature COMPLETELY thus creating a FULLY AUTOMATED machine with perfect respect of personal and environmental hygiene, as it is directly connected to the sewage system or to a larger storage tank should the machine be installed in isolated transit zones such as remote parking areas along the motorway network or ports, with the added benefit of discouraging illegal emptying into the environment.

Another purpose of this machine is to ensure the internal and external sanitizing of the sewage holding tanks, in complete safety, so that even less experienced users are able to use the machine, and products of commonly commercial availability are supplied in order to ensure an efficient and competitive economic return.

BRIEF DESCRIPTION OF DRAWINGS

The operational process of the machine and its advantages will become more apparent as they are highlighted through the description of the invention and illustrated by means of non-exhaustive and/or limitative examples in the accompanying drawings:

Page 1/11 FIG. 1.1 depicts the insertion of the WC tank (A) in the machine on the insertion slide (B) positioned within a rotating platform (C) through a sliding entry door; FIG. 1.2 is an exploded view of the WC tank (A) in which the pour-out spout (G), the closure cap (J), a cover slide (L) and opening blade (R) are identified. FIG. 1.3 depicts the positioning of all the new parts in relation to each other.

Page 2/11 FIG. 2.1 depicts, in perspective view, the position within the machine of the mechanism to rotate the pour-out spout (G) and FIG. 2.2 depicts in plan, the procedure of rotation of the pour-out spout (G) which in brought about by the rotation of the tank (A) on the rotating platform (C) and a lever (F) which forces the rotation of the pour-out spout (G); FIG. 2.3 illustrates the same procedure.

Page 3/11 FIG. 3.1 depicts, in perspective view, the position with respect to the central rotating platform of the apparatus (H) used for the unscrewing of the closure cap (J) of the pour-out spout (G) of the sewage tank (A);

Page 3/11 FIG. 3.2 depicts the process of approach of the device (H) to the cap (J), by extension of a mechanical arm, the unscrewing of the cap (J) which closes the pour-out spout (G), and withdrawal of the device (H) now retaining the cap (J) within it grip;

Page 3/11 FIG. 3.3 illustrates the cylinder's internal strips as they are situated on the inside of the cylindrical device; FIG. 3.4 gives an overall view of the cylindrical device mounted on a mechanical arm.

Page 4/11 FIG. 4.1 illustrates the position inside the machine, with respect to the central rotating platform, of the apparatus (I) that cleans and sanitizes the closure cap (J) of the pour-out spout (G) of the tank (A);

FIG. 4.2 depicts the process of cleaning the cap (J) once it has been unscrewed from the pour-out spout (G) of the tank (A); the mechanical arm of device (H) swivels to align and insert the cap into apparatus (i).

FIG. 4.3 illustrates the internal brush structure of apparatus (i); FIG. 4.4 illustrates the alignment of device (H) with apparatus (i).

Page 5/11 FIG. 5.1 illustrates the position of interface masks (K) inside the machine in relation to the rotating platform (C) and WC sewage tank (A); FIG. 5.2 illustrates the lateral movement of the masks to align the mask that corresponds to the model of tank inserted; FIG. 5.3 illustrates details of the interface mask (K) with shutter and latch;

Page 6/11 FIG. 6.1 illustrates the pivoting of the central container of the rotating platform (C) enclosing the tank (A); FIG. 6.2 depicts a sequential view of the lifting of the central container and tank, the coupling of the tank with the interface masks (K) and the draining of the tank through its pour-out spout (G);

Page 7/11 FIG. 7.1 depicts in an elevation plan view, the internal washing pressure lance (M) that is inserted into the opening of the tank and the sanitizing process by means of a metering valve with detergents; FIG. 7.2 is a plan view which shows the return of the tank to its horizontal plane;

Page 8/11 FIG. 8.1 illustrates the positioning of the tank with respect to injector/nozzle (N) for reloading of toilet fluids; FIG. 8.2 depicts the process of rotating and filling the holding tank (A) with sanitation fluids;

Page 9/11 FIG. 9.1 depicts, in plan view, the re-screwing of the now sanitized closure cap (J) to the pour-out spout (G)

Page 10/11 FIG. 10.1 illustrates the position of the shaped lever (O) for the closing of the pour-out spout (G); FIG. 10.2 shows the static model of the template block shaped lever (O); FIG. 10.3 depicts in plan view, the pivoting of the pour-out spout (G) forced to return to its home position due to the leverage applied by this block (O) during rotation of the platform (C).

Page 11/11 FIG. 11.1 depicts the process by which the outside of tank (A) is washed by rotating brushes (P) and dried through vertical and horizontal air blades to be returned to the user;

BEST MODE FOR CARRYING OUT THE INVENTION

With particular reference to the alphabetic indicators of the above figures, the machine, subject of the invention, consists of a parallelepiped upright casing with an opening for the insertion of a sewage-holding tank (A), through a sliding safety door activated by a payment system.

The sewage holding tank (A) is placed on a sliding plate (B) which is positioned to assist horizontal movement of the tank to its correct position within the container/cradle as shown in FIG. 1.1

After this insertion a detection systems recognizes both the correct insertion of the tank and the type of the tank inserted. A process management system positions the correspondant mask and adapts the work plane according to the type of tank inserted. The safety door closes and the process initiates.

The platform (C) rotates anticlockwise on a vertical axis until it reaches a first control point where it awaits the positioning of a shaped lever (F). An actuator inserts this lever between the body of the tank (A) and the pour-out spout (G). Through the movement of platform (C) in the opposite direction the lever forces the pour-out spout (G) to pivot to perpendicular with respect to the tank.

A subsequent anticlockwise rotation of the platform (C) to a second control point aligns the tank to cylindrical device (H) on the extremity of a mechanical arm. This arm extends the device (H) to grip the closing cap (J) on the pour-out spout (G) Once the cap has been secured in the device (H), this latter rotates to unscrew the cap. The mechanical arm retreats, withdrawing the cap from the pour-out spout, and rotates to align the cap with its cleaning mechanism (i) to be once washed and sanitized;

The system retains the cap and inserts it in a cylindrical container (I) the circumference and centre of which is covered with brushes. The rotational movement of the mechanical arm rotates the cap on its axis against the brushes, at the same time detergent and water are sprayed into the inside of the cylinder (I).

A further clockwise rotation of the platform (C) aligns the holding tank (A) with the previously selected mask (K). The container/cradle of the rotating platform (C) is tilted on its vertical axis. The tank starts emptying its contents due to gravitational fall.

Once the holding tank is vertical it couples with the interface mask (K). The sliding lid (L) which connects the tank and the toilet basin itself is opened together with the underlying opening blade (R), in order to allow a lance (M) to be inserted into the tank. This lance (M) has rotating nozzles at it extremity which start the internal washing cycle by spraying pressurized water and sanitizing detergent into the tank.

A reverse procedure is activated following the washing process in order to bring the holding tank (A) back to its horizontal position and allows the reloading of the tank with sanitizing fluids by inserting a dosing injector (N) through the pour-out spout;

The tank, through the anti-clockwise rotation of platform (C), is returned to the automatic system (that by reversing the previously described UN-screwing process) correctly RE-screws and tightens the now sanitized closure cap (J) to the pour-out spout (G). A subsequent anti-clockwise rotation of platform (C) forces the pour-out spout against template block (O) and levers it back to its home position against the side of the tank;

Two motors push the plate (B), holding the tank (A) within the container/cradle, into position between rotating brushes (P) under a spray of water and detergents to ensure its external cleanliness. The tank is subsequently dried by pulling the plate and tank through vertical air blades.

The platform rotates the tank to home position and the security latch holding the tank to the sliding plate is released.

An indicator signals the end of the process and the security doors open for the use to withdraw the holding tank.

Between one wash cycle and another the machine automatically performs its own flushing and rinsing with biodegradable sanitizing products in order to ensure perfect hygiene for each cycle.

The invention is equipped with safety mechanisms so as to impede accidental opening of the machine during its operating cycle; it is equipped with UPS and an emergency water tank capable of reaching the end of a processing cycle even in case of interruption of the electrical or water supply.

From a constructive point of view the machine is preferably made of metallic materials protected by weather resistant paint or polymer or stainless steel and in any case must comply with regulations.

All active parts of the machine (motors, actuators, sensors, etc.), and the entire operating cycle runs on low voltage, up to 24 volts derived from a transformer input 220 AC single phase output 24 volts DC; materials used: ip 66.

The invention claimed is:

1. A semi-automatic machine for emptying and cleaning a portable sewage-holding tank, comprising an upright casing with an opening for the insertion of the sewage-holding tank, a safety opening, a means for horizontal rotation for emptying the tank, and a means for internal rinsing of the tank, wherein the tank is placed on a sliding plate, and the sliding plate is positioned to assist horizontal movement of the tank to its correct position within the casing, wherein a detection system recognizes the correct insertion of the tank and the type of tank inserted, wherein a rotating platform comprises a means for lifting the tank vertically to empty it and wherein the rotating platform is set in motion by a motor fixed in the machine wherein the center of the platform consists of a parallelepiped-shaped container void of a front side and void of a top side further consisting of two lateral slots along the sides close to the base, wherein the container is attached to the platform, along its shorter side, by a hinge, wherein the inside of the container consists of two optical sensors, wherein a motor-reducer with a worm screw is positioned between the platform and the container for operating a lever which lifts the container by pivoting it on the hinge until it reaches a vertical position, wherein the base of the container holds a rolling trolley plate secured thereto by two extendable telescopic guides and the plate further comprises an optical sensor and a latch for holding the inserted tank, wherein the rolling trolley plate is set in motion by two motors fixed to the outer sides of the container itself that, by means of gears through the lateral slots along the container sides, transmit the motion to two cog-wheel racks fixed on the insides of the same container.

2. The machine of claim 1, further comprising a shaped lever positioned on the inside right of the machine wherein the shaped lever is operated by an actuator that slots the lever between the body of the tank and a pour-out spout thus enabling the rotation of the spout by 90° on its fulcrum.

3. The machine of claim 2, further comprising a device for automated unscrewing and re-screwing of a cap of the our-out spout, wherein the device is cylindrical and has an inner diameter greater than the diameter of the closure cap of the pour-out spout of the tank, and wherein the device is mounted at one extremity of a mechanical arm wherein the cylinder contains strips of a rough surfaced harmonic material and wherein the material strips are fixed by one of their extremities to the inner edge of the cylinder entrance and wherein the other end is free on its inside wherein the cylinder further comprises a sensor positioned at the bottom of the cylinder, that detects the correct positioning of the cap.

4. The machine of claim 3, wherein the cylindrical container comprises an inner circumference covered by brushes.

5. The machine of claim 4, further comprising interface masks positioned vertically towards the rear interior of the machine, tangent to the rotating platform wherein at the center of each mask there is a rectangular shaped shutter with two protrusions at its upper and lower ends wherein an actuator moves the rectangular shaped shutter upwards or downwards via a moving sash, and wherein a latch at the side of the mask engages a knob which opens or closes a vent blade inside the tank.

6. The machine of claim 5, further comprising a template block, wherein the template block consists of a shaped lever positioned inside the left of the machine that takes advantage of the clockwise or counter-clockwise rotation of the platform, pushes the pour-out spout of the tank by about 90° from its open position to home position of rest, wherein the motion is fully automatic without manual intervention.

7. The machine of claim 6, further comprising one or more copper pipes distributed inside the machine that reach internal elements that contribute to the cleaning or mechanical handling of the tank, nozzles that atomize sanitizing liquid are installed along this pipe in order to cleanse the machine.

8. The machine of claim 1, wherein the sewage-holding tank is used in recreational vehicles such as camper vans, caravans, motorhomes, boats or tourist planes.

9. The machine of claim 1, wherein the internal rinsing of the tank is done by spraying pressurized water.

10. The machine of claim 1, wherein the internal rinsing of the tank is done by spraying pressurized water and sanitizing detergent.

11. The machine of claim 1, wherein the sewage-holding tank consists of a Thetford or Dometic device.

12. The machine of claim 3, wherein the material strips are bent at their point of junction at an angle of less than 90° so as to form a cone inside the cylinder.

13. The machine of claim 3, wherein the mechanical arm is set in motion by three motors, wherein the first motor enables movement on the horizontal plane and aligns the cylinder to the pour-out spout wherein the second motor, via a worm screw, enables the extension of the cylinder towards the cap and exerts pressure until the cap is completely inserted inside it thus activating the sensor, wherein the third motor sets the cylinder rotating in the direction for unscrewing or screwing of the cap, and wherein the direction may be clockwise or anti-clockwise.

14. The machine of claim 4, wherein the cylinder is connected via tubing to a metering device which sprays the surface of the brushes with cleansing liquid.

15. The machine of claim 7, wherein the sanitizing liquid is stored in internal tanks.

* * * * *